US010734212B2

(12) United States Patent
Haufler et al.

(10) Patent No.: US 10,734,212 B2
(45) Date of Patent: Aug. 4, 2020

(54) HOMOGENIZATION OF THE PULSED ELECTRIC FIELD CREATED IN A RING STACK ION ACCELERATOR

(71) Applicant: DH Technologies Development PTE Ltd., Singapore (SG)

(72) Inventors: Robert Haufler, Toronto (CA); William M. Loyd, Sugar Land, TX (US); Alexander Tsipirovich, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/108,203

(22) PCT Filed: Dec. 20, 2014

(86) PCT No.: PCT/IB2014/002853

§ 371 (c)(1),
(2) Date: Jun. 24, 2016

(87) PCT Pub. No.: WO2015/101824

PCT Pub. Date: Jul. 9, 2015

(65) Prior Publication Data

US 2016/0329201 A1 Nov. 10, 2016

Related U.S. Application Data

(60) Provisional application No. 62/094,283, filed on Dec. 19, 2014, provisional application No. 61/922,973, filed on Jan. 2, 2014.

(51) Int. Cl.

*H01J 49/00* (2006.01)
*H01J 49/06* (2006.01)
(Continued)

(52) U.S. Cl.

CPC ..... *H01J 49/065* (2013.01); *H01J 49/022* (2013.01); *H01J 49/26* (2013.01); *H01J 49/403* (2013.01); *H05H 5/06* (2013.01)

(58) Field of Classification Search

CPC ..... H01J 49/00; H01J 49/0086; H01J 49/02; H01J 49/022; H01J 49/062; H01J 49/065; H01J 49/068; H01J 49/06
(Continued)

(56) References Cited

U.S. PATENT DOCUMENTS 4,264,125 A * 4/1981 Shibata ..... G02F 1/292 359/276
2001/0032929 A1 10/2001 Fuhrer et al.
(Continued)

OTHER PUBLICATIONS

International Search Report and Written Opinion for PCT/IB2014/002853 dated May 21, 2015.

*Primary Examiner* — Jason L Mccormack

(57) ABSTRACT

A ring stacked accelerator for use in a mass spectrometer includes a plurality of ring shaped plates arranged in a stack and is electrically coupled to a voltage divider that allows a substantially homogeneous electric field to be produced when the stack is energized. The voltage divider can include resistors and capacitors, where the capacitors are chosen to compensate for parasitic capacitances experienced by the plates. The ring stacked accelerator can be energized using an RF pulse. The ring stack accelerator can include one or more balancing capacitors for correcting effects that cause nonlinearity.

7 Claims, 19 Drawing Sheets

(51) Int. Cl.

| | |
|---|---|
| ***H05H 5/06*** | (2006.01) |
| ***H01J 49/40*** | (2006.01) |
| ***H01J 49/02*** | (2006.01) |
| ***H01J 49/26*** | (2006.01) |

(58) Field of Classification Search
USPC ..... 250/281, 282, 290, 293
See application file for complete search history.

(56) References Cited

U.S. PATENT DOCUMENTS

| | | | | |
|---|---|---|---|---|
| 2004/0051036 | A1* | 3/2004 | Franzen | H01J 49/4225 250/282 |
| 2004/0108451 | A1* | 6/2004 | Hansen | H01J 43/246 250/281 |
| 2008/0210861 | A1* | 9/2008 | Wu | G01N 27/624 250/287 |
| 2008/0251715 | A1* | 10/2008 | Nikolaev | G21K 1/093 250/288 |
| 2009/0129131 | A1* | 5/2009 | Hosemans | H01J 49/105 363/89 |
| 2010/0327785 | A1 | 12/2010 | Crewson et al. | |
| 2013/0009051 | A1* | 1/2013 | Park | H01J 49/063 250/282 |
| 2014/0158878 | A1* | 6/2014 | Green | H01J 49/065 250/282 |
| 2015/0160161 | A1* | 6/2015 | Nacson | G01N 1/2273 250/282 |
| 2018/0048245 | A1* | 2/2018 | Wohlgethan | H01J 49/063 |

* cited by examiner

C15,C44-C57 Capacitors between accelerator plates

C1,C2,C3,C4,C5 Parasitic capacitors

C15,C44-C57 Capacitors between accelerator plates

C1,C2,C3,C4,C5 Parasitic capacitors

C6-C14,C16-C21 Compensation capacitors

101. Estimate plate-to-plate capacitance in static mode for DC voltage.

102. Test accelerator with high voltage pulse that has a 1 microsecond duration.

103. Calculate parasitic capacitance using simulation tools.

104. Correct calculations by adjusting estimates of parasitic capacitance.

105. Create systems electric schematic/model including estimated parasitic capacitance.

106. Perform circuit simulation and select compensation capacitors

107. Create final circuit schematic that includes selected capacitors.

108. Test accelerator with high voltage pulse that has a 1 microsecond duration.

109. Correct final schematic and perform final simulation.

110. Test on full instrument.

100

FIG. 11

C3-C15 Capacitors between accelerator plates

Figure 1. Fragmentation mass spectrum of Glu Fibrino peptide. Fragments formed by collisional induced dissociation with nitrogen gas at 40 eV kinetic energy.

| Theoretical m/z | Measured m/z | Error (ppm) |
|---|---|---|
| 72.08078 | 72.08078 | 0 |
| 88.03930 | 88.03925 | -0.6 |
| 175.11895 | 175.11905 | 0.6 |
| 187.07133 | 187.07140 | 0.4 |
| 246.15607 | 246.15608 | 0.1 |
| 286.13975 | 286.13991 | 0.6 |
| 333.18809 | 333.18806 | -0.1 |
| 480.25651 | 480.25619 | -0.7 |
| 684.34639 | 684.34632 | -0.1 |
| 813.38898 | 813.38875 | -0.3 |
| 942.43157 | 942.43124 | -0.3 |
| 1056.47450 | 1056.47481 | 0.3 |
| 1171.50144 | 1171.50141 | 0 |
| 1285.54437 | 1285.54477 | 0.3 |

FIG. 17

HOMOGENIZATION OF THE PULSED ELECTRIC FIELD CREATED IN A RING STACK ION ACCELERATOR

RELATED APPLICATIONS

This application claims priority to U.S. provisional application No. 61/922,973, filed on Jan. 2, 2014, entitled "Homogenization of the Pulsed Electric Field Created in a Ring Stack Ion Accelerator," which is incorporated herein by reference in its entirety and to U.S. provisional application No. 62/094,283, filed on Dec. 19, 2014, entitled "Homogenization of the Pulsed Electric Field Created in a Ring Stack Ion Accelerator," which is incorporated herein by reference in its entirety.

FIELD

The invention generally relates to mass spectrometry, and more particularly to methods and apparatus utilizing a ring stacked accelerator.

BACKGROUND

In mass spectrometry, a solid, liquid, or gas sample contains atoms or molecules that are targets for study, usually quantification or identification. The targeted atoms or molecules are ionized and introduced into a mass spectrometer in the gas phase. The ionized atoms or molecules (ions) are separated according to their charge-to-mass ratio and are detected by a mechanism capable of detecting charged particles. The resulting signals are processed and organized into a spectrum that presents the relative abundance of the different ions as a function of ion mass-to-charge. This information is used for identification and quantification. Identification is accomplished by correlating the detected mass-to-charge to known or expected mass-to-charge. Alternatively, a characteristic fragmentation pattern may be used where ions that result from structural disintegration of the primary molecular structure are similarly separated and detected.

Separation of ions based on the mass-to-charge ratio can be accomplished by many techniques. One such the technique is time-of-flight (TOF) mass spectrometry. In the time-of-flight technique, ions of different mass-to-charge ratios are subjected to constant energy acceleration. The ions are then detected at a distance away from the location of acceleration. At the detection location, the ions will impinge upon a detector at different times that are related to the ion mass-to-charge according to the formula:

$$t = m^{1/2} \cdot d \cdot \sqrt{\frac{KE}{2}}$$

Where:

t is the time required for the ion to travel the distance from the point of acceleration to the detector, m is the ion mass-to-charge, d is the distance between the point of acceleration and the detector, and KE is the energy the ions receive in the acceleration.

With the distance and the energy being constant, the ion flight time will depend on the square root of the mass-to-charge. It is often the case that ions enter the accelerator, and are subsequently accelerated, making the time-of-flight technique a pulsed technique. This means that the ions are created in pulses, such as in the case of laser ionization, or when the accelerating electric field is pulsed (switched on rapidly).

The accelerator is an important component of the time of flight technique. It is usually the case that multiple ions are present during any single acceleration event. The different ions may not share the same location in the accelerator. Thus, a task of the accelerator is to create an accelerating electric field that is the same regardless of the ion location. In other words, the accelerator should have a substantially homogeneous electric field for the active volume of the accelerator, the active volume being the space in the accelerator through which any ion that will be subsequently detected will travel.

A homogeneous electric field is created ideally by two perfectly parallel plates separated by some distance—Z, that have infinite dimensions in X and Y, with a potential difference between them. In practice, dimensions X and Y are finite, and this introduces problems with field penetration from the edges of the plates. Also, one plate is typically replaced by a grid that will allow most ions to pass through. If the plates are spaced with a very small Z spacing, the field penetration will be lessened. However, if for some reason, it is desired to have a large Z spacing, the field penetration will destroy the homogeneity and the accelerator will not apply the same kinetic energy to ions at different locations in the accelerator. In this case, the variation in ion flight times will be large, and the resolving power of the spectrometer will decrease. A strategy to minimize the field penetration from the sides is to use "field homogenizing" plates placed between the original two plates. These field homogenizing plates will have an applied potential that is linearly varying depending on the position between the two original plates. This assembly can be called a ring-stack accelerator (RSA). In the case where the ions are created in pulses, such as in laser ionization, the potential can be applied to the field homogenization plates by a resistive voltage divider network. In this mode, Ohms law will apply. But if the atoms and molecules are ionized elsewhere and introduced into the RSA, the field in the RSA will have to be switched off to allow the ions to enter, then switched on to provide the acceleration. In this situation, the switching on and off will happen very rapidly, and Ohms law will not apply. The voltage division will depend mostly on the capacitance values between all the plates and between the plates and the surrounding environment. It would be desirable to achieve a homogeneous electric field for the situation where the electric field switches on and off in an RSA.

SUMMARY

In one aspect, an accelerator for use in a mass spectrometer is disclosed, which includes a first plurality of electrically conductive plates arranged in a stack with a gap separating any pair of the plates, and a first resistor voltage divider electrically coupled to the plates. A plurality of capacitors is electrically coupled to the plates and configured to allow generating at each plate, in response to application of a voltage pulse (e.g., an RF voltage pulse) across the stack, a voltage pulse having an amplitude that varies substantially linearly from a first plate in the stack to a last plate in the stack. For example, the voltage can decrease linearly in a downstream direction. The RF pulse can have a frequency in a range of about 1 Hz to about 200,000 Hz, an amplitude in a range of about 100 volts to about 10,000 volts, and a duration in a range of about 1 microsecond to about 100 microseconds. In some embodiments, the amplitude of the voltage pulse applied across the stack can be constant over the pulse duration. By way of example, the RF voltage pulse can be applied across the stack by electrically coupling the first plate in the stack to a voltage source and electrically grounding the last plate in the stack.

The capacitors can be arranged to provide a capacitor voltage divider in parallel with the resistor voltage divider. In some embodiments, the capacitors in the capacitor voltage divider are discrete capacitors having values that substantially compensate for parasitic capacitances in said first plurality of plates.

In some embodiments, an electric field generated by the plurality of electrically conductive plates is substantially homogeneous at least along a longitudinal axis of the stack, and preferably within an active volume of the stack. In some embodiments, the capacitors are configured such that the plates exhibit substantially equal electrical impedances at a frequency of the RF pulse. The capacitors can have a capacitance in a range of, e.g., about 20 picoFarads to about 10 nanoFarads.

In some embodiments, each plate includes an opening, e.g., a central opening, to allow passage of a plurality of ions therethrough.

In some embodiments, the accelerator can further include a second plurality of electrically conductive plates arranged in a stack with a gap separating any pair of the plates, and a second resistor voltage divider electrically coupled to said second plurality of conductive plates, wherein the second plurality of electrically conductive plates is configured to be energized via application of a DC voltage thereto.

In a related aspect, an accelerator for use in a mass spectrometer can be provided comprising a first plurality of conductive plates arranged in a stack with a gap separating any pair of said plates; a first resistor voltage divider electrically coupled to said plates; one or more capacitors coupled to said plates and configured to allow generating at each plate, in response to application of a voltage pulse across the stack, a voltage pulse having an amplitude that varies substantially linearly from a first plate in said stack to a last plate in said stack; and one or more balancing capacitors for correcting effects that cause nonlinearity.

In some embodiments, the capacitors can be arranged to provide a capacitor voltage divider in parallel with said first resistor voltage divider.

In some embodiments, the capacitors in the capacitor voltage divider can be discrete capacitors having values that substantially compensate for parasitic capacitances in the first plurality of conductive plates.

In some embodiments, an electric field created by the first plurality of conductive plates can be substantially homogeneous at least along a longitudinal axis of said stack when energized with said RF pulse.

In some embodiments, the capacitors can be configured such that the plates exhibit substantially equal electrical impedances at a frequency of said RF pulse.

In some embodiments, each of said plates can comprise an opening to allow passage of a plurality of ions therethrough.

In some embodiments, a first plate of the first plurality of conductive plates can be electrically coupled to a source configured to provide said RF pulse.

In some embodiments, the accelerator can further comprise a second plurality of conductive plates arranged in a stack with a gap separating any pair of said plates; and a second resistor voltage divider electrically coupled to said second plurality of conductive plates, wherein the second plurality of conductive plates can be configured to be energized via application of a DC voltage thereto.

In a related aspect, a mass spectrometer is disclosed that includes a ring stacked accelerator for receiving a plurality of ions and accelerating the ions. The ring stacked accelerator can include a first plurality of electrically conductive plates arranged in a stack with a gap separating any pair of the plates, a first resistor voltage divider electrically coupled to the plates, and a capacitor voltage divider electrically coupled to the plates in parallel with the first resistor voltage divider, wherein the capacitor voltage divider is configured such that an electric field generated by said first plurality of conductive plates in response to application of an RF voltage pulse to said stack is substantially homogeneous at least along a longitudinal axis of the stack, and preferably in an active volume thereof. The mass spectrometer can further include a detector disposed downstream of the accelerator and configured to detect at least one property of the accelerated ions, e.g., their relative m/z ratios. In some embodiments, the first plate in the stack is coupled to a voltage source and the last plate is electrically grounded for application of the voltage pulse across the stack.

The capacitors in the capacitor voltage divider in the above mass spectrometer can be discrete capacitors having values that substantially compensate for parasitic capacitances in the first plurality of conductive plates. By way of example, the capacitors can have a capacitance in a range of about 20 picoFarads to about 10 nanoFarads.

In some embodiments, the ring stacked accelerator in the mass spectrometer can include a second plurality of electrically conductive plates arranged in a stack with a gap separating any pair of the plates, a second resistor voltage divider electrically coupled to the second plurality of conductive plates, wherein the second plurality of conductive plates is configured to be energized with a DC voltage. In some embodiments, each of the plates can include a central opening for passage of ions therethrough. A plate with an opening can also be referred to as a ring. A longitudinal axis of the stack can extend through the centers of said central openings.

In a related aspect, A mass spectrometer can be provided comprising a ring stacked accelerator for receiving a plurality of ions and accelerating said ions, said ring stacked accelerator can comprise a first plurality of conductive plates arranged in a stack with a gap separating any pair of said plates, a first resistor voltage divider electrically coupled to said plates, and a capacitor voltage divider electrically coupled to said plates in parallel with the first resistor voltage divider, wherein said capacitor voltage divider is configured such that an electric field generated by said first plurality of conductive plates in response to application of a voltage pulse to said stack in substantially homogeneous at least along a longitudinal of said stack; one or more balancing capacitors for correcting effects that cause nonlinearity; and a detector disposed downstream of said accelerator and configured to detect at least one property of said accelerated ions.

In some embodiments, the capacitors in the capacitor voltage divider can be discrete capacitors having values that substantially compensate for parasitic capacitances in the first plurality of conductive plates.

In some embodiments, a first plate of the first plurality of conductive plates can be electrically coupled to a source configured to provide said RF pulse.

In some embodiments, the ring stacked accelerator can further comprise a second plurality of conductive plates arranged in a stack with a gap separating any pair of said plates; and a second resistor voltage divider electrically coupled to said second plurality of conductive plates, wherein the second plurality of conductive plates can be configured to be energized with a DC voltage.

In some embodiments, each of said plates can comprise a central opening for passage of said ions therethrough.

In some embodiments, the longitudinal axis extends through centers of said central openings.

In another aspect, a method for improving the RF performance of a mass spectrometer having a ring accelerator is disclosed, which includes estimating plate-to-plate capacitance of plates in the ring stacked accelerator, estimating parasitic capacitances for the plates at one or more RF frequencies, determining capacitance of each of a plurality of compensation capacitors for compensating said parasitic capacitances, and utilizing said capacitors to form a capacitor voltage divider for electrically coupling to the plates of the stacked accelerator, such that an electric field generated by the plates in response to application of an RF voltage pulse having said one or more frequencies across said stacked accelerator is more homogeneous than a respective electric field generated by application of said pulse to the stacked accelerator in absence of the capacitor voltage divider.

In some embodiments, the step of determining the capacitances of said compensation capacitors can include calculating values of each capacitor in the capacitor voltage divider such that the capacitance at each plate is substantially the same at said one or more RF frequencies.

In some embodiments, the method can further include the step of simulating an electric field generated by the ring stacked accelerator with the capacitor voltage divider incorporated into the stack prior to the step of electrically coupling the capacitor voltage divider to the plates. In some embodiments, the duration of the RF voltage pulse can be in a range of about 1 to about 100 microseconds, and its amplitude can be in a range of about 100 volts to about 100,000 volts. In some cases, the RF voltage pulse has a uniform amplitude over the pulse duration.

In a related aspect, A method can be provided for improving the RF performance of a mass spectrometer having a ring stacked accelerator, comprising steps of estimating plate-to-plate capacitance for plates in said ring stacked accelerator; estimating parasitic capacitances for the plates at one or more RF frequencies; determining capacitance of one or more compensation capacitors for compensating said parasitic capacitances; utilizing said capacitors to form a capacitor voltage divider for electrical coupling to the plates of the stacked accelerator, such that an electric field generated by the plates in response to application of an RF voltage pulse having said one or more frequencies across said stacked accelerator is more homogenous than a respective electric field generated by application of said pulse to the stacked accelerator in absence of the capacitor voltage divider; and correcting effects that cause nonlinearity.

In some embodiments, the step of correcting effects that cause nonlinearity can comprise providing one or more balancing capacitors.

In some embodiments, the method can further comprise testing the mass spectrometer to confirm that the capacitor voltage divider improves performance of the mass spectrometer when said RF voltage pulse is applied to the ring stacked accelerator.

In some embodiments, the step of determining the capacitances of said one or more compensation capacitors can further comprise calculating values for each capacitor in the capacitor voltage divider such that the capacitance at each plate can be substantially the same at said one or more RF frequencies.

In some embodiments, the method can further comprise the step of simulating an electric field generated by the ring stacked accelerator with the capacitor voltage divider prior to the step of electrically coupling the capacitor voltage divider to the plates.

In some embodiments, the RF pulse can be a high voltage pulse of approximately 1 μs duration, and optionally wherein said RF pulse can have a substantially uniform amplitude over the pulse duration.

DESCRIPTION OF FIGURES

FIG. 11 is a flow chart depicting an exemplary method for correcting for parasitic capacitance.

FIG. 17 shows a table of masses observed in the mass spectrum depicted in FIG. 16;

DETAILED DESCRIPTION

Figure 1:
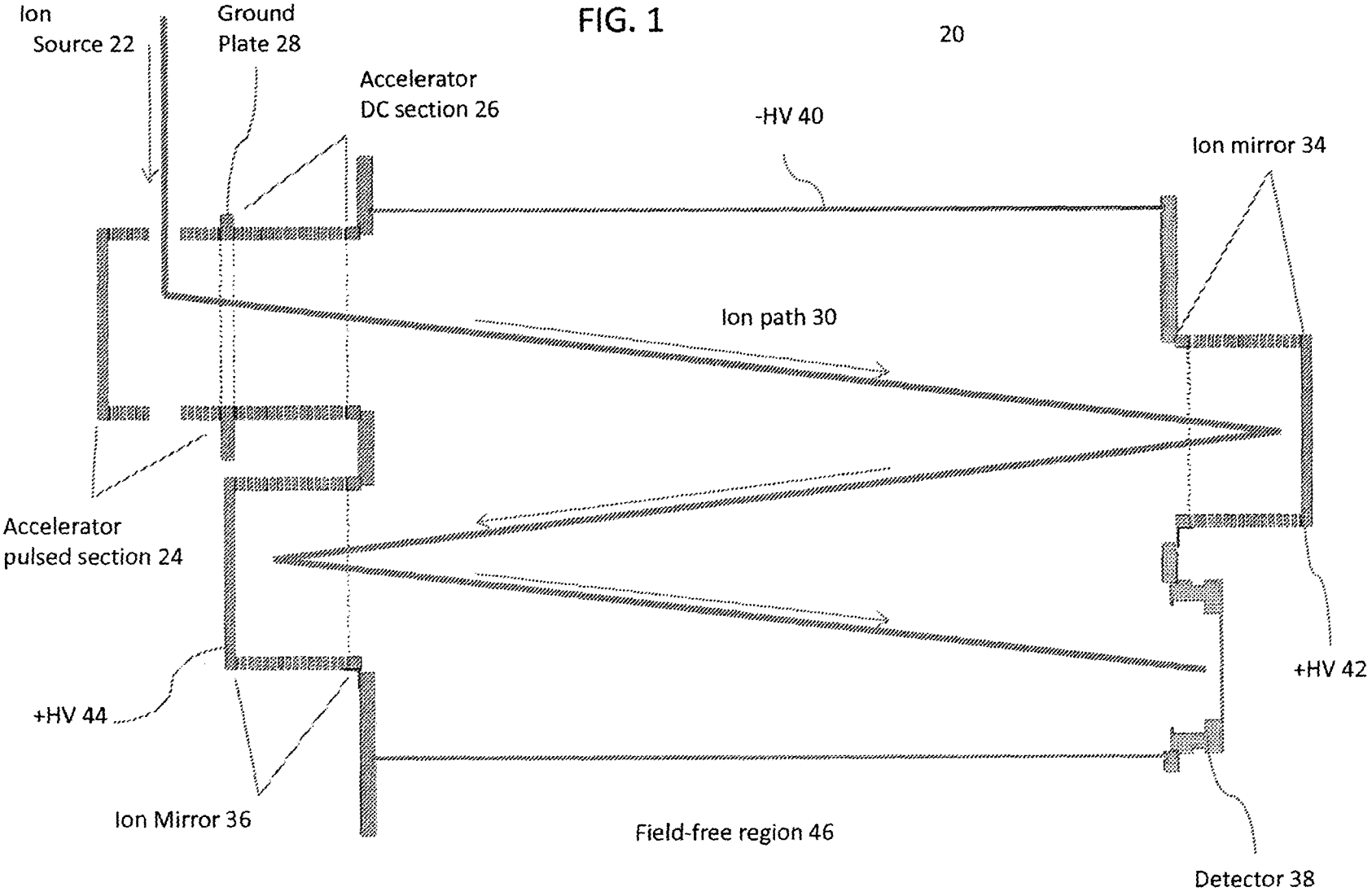
FIG. 1 is a cutaway of an exemplary mass spectrometer that can be used with some embodiments.

The present invention is generally directed to a ring stacked accelerator (RSA) for use in a mass spectrometer that can be utilized to generate a substantially homogeneous (uniform) electric field within a volume of the stacked accelerator, and at least along a longitudinal axis thereof, in response to application of voltage pulse, e.g., a radio frequency (RF) voltage pulse, across the stacked accelerator. The goal of the ring stack accelerator is an electric field that has two states: on and off. The on state is a non-zero electric field that has the magnitude necessary to lead to space-time-velocity focusing of ions at the detector. The field on state must have a period that is longer than the time it takes for the slowest, highest mass-to-charge ion to exit the accelerator. This period is about 1-20 microseconds, depending on the mass-to-charge ratio of the ion of interest. For this entire duration, the pulse must maintain the electric field constant The field must not change whilst the ions are within the electric field. Otherwise, time dependent effects will be observed, which will appear as mass dependent effects. The faster moving, low mass-to-charge ions will experience a different acceleration than the slower moving, high mass-to-charge ions. The electric field must have a controllable and knowable value, and the field must be very homogeneous (meaning the field has the same value at all locations within the operational volume within 0.1% to 0.00001%) depending on the performance requirements. During the off state, the ions are allowed to enter the electric field. Zero field means that the ion trajectory is not perturbed, and Newton's first law will apply. During the on state, ions are accelerated into the remaining sections of the TOF analyzer with a well-known and controlled mass/space/initial ion velocity dependent velocity, thereby allowing time focusing of the ions by mass-to-charge on the detector. The time between the off state and the on state must be kept as short as possible in order to prevent any effects that will cause problems in achieving the goal of high precision focusing. Great efforts are taken to create devices that can produce the required voltage pulse having a very fast rise time, very little ringing, and a very flat top. Assuming that such a pulse is in hand, problems still result in the ring stack accelerator for the reasons given (parasitic capacitances and time dependent charging). The present invention addresses these issues.

A plate with an opening can also be referred to as a ring. The terms "balancing capacitor" and "compensation capacitor" can be used interchangeably herein. The term "substantially uniform electric field" as used herein refers to an electric field whose magnitude varies by a very small amount, 0.1% or less, at different spatial points, e.g., spatial points within a volume of the stacked accelerator or along a longitudinal axis of the stacked accelerator. The term "RF voltage pulse" as used herein refers to a time-varying voltage having a finite duration, e.g., in a range of about 1 microsecond to about 100 microseconds, and a frequency in a range of about 1 Hz to about 200,000 Hz, e.g., in a range of about 3000 Hz to about 200,000 Hz. In some embodiments, such a voltage pulse has a substantially uniform amplitude, e.g., an amplitude that exhibits variations of less than about 0.10%, or less over the pulse duration. In some embodiments, the RSA includes a plurality of electrically conductive plates that are arranged in a stack with a gap separating any two of the plates. A resistor voltage divider is electrically coupled to the plates. In addition, a capacitor voltage divider is coupled to the plates in parallel with the resistor voltage divider. The capacitor voltage divider includes a plurality of capacitors, each of which is electrically coupled in parallel to one of the plates of the stacked accelerator. The ring stack accelerator entirely relies on the capacitance between the rings in the stack to provide the capacitive voltage dividing. On the timescales of the pulse used in ring stack accelerators, ohmic, or resistive voltage dividing cannot be used. It is just too slow to charge the plates by passing current through resistors. On a long enough timescale (more than a millisecond), the voltage dividing becomes entirely ohmic. But during the relevant time period (which is between a few nanoseconds and a few microseconds), it is the capacitive network that divides the voltage. It is extremely helpful that the ring stack accelerator is constructed by spacing of multiple identical plates by identical distances, creating identical capacitors, in the absence of any parasitic capacitances. There is an additional issue. Again, this is an issue of timescale. For a ring stack accelerator with many plates, it is those plates that are located between the ends, those in the middle, that are slowest to come to operational voltage. This causes time dependent behavior that will be manifested in problems with mass calibration and with homogenous mass resolution across the mass range. This invention, the use of compensation capacitors, must correct the problems introduced to the ring stack accelerator by both the parasitic capacitances and due to time dependent charging of the rings. One embodiment of this invention is to attach compensation capacitors between the plates to correct the problems of the parasitic capacitances and the time dependent issues. Another embodiment would be to adjust the dimensions of the plates so that the plate to plate capacitance varies along the ring stack accelerator producing plate-to-plate capacitor values that are precisely that which is necessary to correct the parasitic capacitance and time-dependent issues.

There are three types of capacitances, two are controllable and precisely knowable, one is largely unknown and is not controllable.

The first type of capacitance is plate to plate capacitance. The values of these capacitances depend on the spacing and dimensions of the plates and rings. Each pair of plates, or rings, are located precisely parallel to each other thus comprise classic, text-book capacitors. The values of all the plate-to-plate capacitances are precisely knowable, measureable, and are controllable within a range, given other constraints. Some of the constrains include dimensions that allow installation into available vacuum chambers, plate separation dimensions sufficient to prevent arcing, electrode shapes and size to allow entrance and exit of ions, and finally, electric field dimensions and magnitudes that ultimately allow time-space-velocity focusing of the ions at the detector.

The second type of capacitance is the compensation capacitors. These are standard capacitors, precisely knowable and controllable, given the constraints of availability.

The third type of capacitance is parasitic capacitance. This is the capacitance between each electrode and the environment. Elements of the environment that affect this type of capacitance include the vacuum chamber, nearby ion guides, or any conductor held at ground voltage or any other voltage close enough to create a non-zero capacitance value between the environmental element and any one of the rings in the ring stack electrode. These capacitances are difficult to know and are largely uncontrolled. The effects of these capacitances is to cause the expected capacitor voltage dividing to deviate from the expected linear behavior leading to a loss in the ability of the time-of-flight mass analyzer system to space-time-velocity focus the ions at the detector.

The capacitance values of the capacitors are selected, e.g., in a manner discussed in more detail below, such that each plate exhibits a substantially uniform impedance at the frequency of the RF pulse. For example, in some cases, the impedances of the plates at the RF frequency vary by less than 10%, or 5%. In some embodiments, the capacitance of each capacitor is selected to compensate for parasitic capacitances associated with a plate to which that capacitor is coupled. Further, in some embodiments, the capacitors are configured such that the combination of the capacitor and resistor voltage dividers allows for a substantially linear variation of voltages at successive plates of the RSA, i.e., from a first upstream plate of the RSA to a last downstream plate thereof, in response to application of an RF voltage pulse across the stack, i.e., across the aforementioned first and last plates. In other words, the voltages at the plates vary linearly from the first upstream plate to the downstream plate or exhibit deviation of less than about 1% or less from such linearity. For example, in some embodiments, the voltages at the plates decrease substantially linearly from the first upstream plate to the last downstream plate. In some embodiments, the capacitance of each of the compensation capacitors can be in a range of about 20 picoFarads to about 10 nanoFarads.

The term "about" as used herein indicates a variation of less than 10%, or less than 5%.

In some embodiments, a ring stacked accelerator (RSA) can include a plurality of substantially parallel ring-shaped plates arranged with a predetermined, substantially uniform gap between the plates in a stack. A resistor voltage divider or ladder can be connected to the plates so as to divide a voltage applied across the entire stack substantially uniformly at each plate such that the generated field between adjacent plates is substantially the same. Each plate in the stack can be connected to its adjacent plates via equivalent value resistors, similar to the DC example discussed above.

There are inherent capacitances between the plates as well as parasitic capacitances between the plates and the environment. When DC voltages are applied to the plates, the capacitance between the plates can be modeled based on the size and arrangement of the plates relative to one another. The application of RF voltages (e.g., at frequencies in a range of about 1 Hz to about 200,000 Hz) to the plates can result in a more complicated situation in which the variations of capacitance between the plates and the parasitic capacitances with the environment can lead to non-linear voltage division and a non-homogeneous electric field.

Embodiments can address these parasitic capacitances and, accordingly, the impedances at higher frequencies by adding additional compensation capacitors to alleviate the problem. This can make it possible to create a more homogenous pulsed electric field than a field generated using a stack of plates with only a resistor voltage divider. These capacitors can be arranged as a capacitor voltage divider in parallel with the resistor voltage divider (and thereby in parallel with the plates). Careful choice of the additional capacitors to add in the parallel voltage divider can result in a substantially more uniform electric field in the ring stack when energizing the stack with electric pulses of predetermined characteristics. In some embodiments, the choice of capacitors can be made as a result of simulation, empirical testing, or any combination thereof. In some embodiments, the effective impedance of the capacitance created at each plate by the surrounding plates and environment can be calculated by simulation and improved by measurement with low-capacitance probes. Once an approximation of the capacitance of each plate is generated, capacitors can be added in parallel to each pair of adjacent plates to substantially normalize the capacitance of each plate pair, such that the effective capacitance for each plate is substantially the same. It should be appreciated that if capacitors are appropriately chosen, the capacitance at each plate can be substantially uniform, making the high-frequency effective circuit of the RSA substantially similar to the ideal DC model of the RSA.

In some embodiments, an accelerator for use in a mass spectrometer can be provided comprising a first plurality of conductive plates arranged in a stack with a gap separating any pair of said plates; a first resistor voltage divider electrically coupled to said plates; one or more capacitors coupled to said plates and configured to allow generating at each plate, in response to application of a voltage pulse across the stack, a voltage pulse having an amplitude that varies substantially linearly from a first plate in said stack to a last plate in said stack; and one or more balancing capacitors for correcting effects that cause nonlinearity.

In some embodiments, the capacitors can be arranged to provide a capacitor voltage divider in parallel with said first resistor voltage divider.

In some embodiments, the capacitors in the capacitor voltage divider can be discrete capacitors having values that substantially compensate for parasitic capacitances in the first plurality of conductive plates.

In some embodiments, an electric field created by the first plurality of conductive plates can be substantially homogeneous at least along a longitudinal axis of said stack when energized with said RF pulse.

In some embodiments, the capacitors can be configured such that the plates exhibit substantially equal electrical impedances at a frequency of said RF pulse.

In some embodiments, each of said plates can comprise an opening to allow passage of a plurality of ions therethrough.

In some embodiments, a first plate of the first plurality of conductive plates can be electrically coupled to a source configured to provide said RF pulse.

In some embodiments, the accelerator can further comprise a second plurality of conductive plates arranged in a stack with a gap separating any pair of said plates; and a second resistor voltage divider electrically coupled to said second plurality of conductive plates, wherein the second plurality of conductive plates can be configured to be energized via application of a DC voltage thereto.

In some embodiments, a mass spectrometer can be provided comprising a ring stacked accelerator for receiving a plurality of ions and accelerating said ions, said ring stacked accelerator can comprise a first plurality of conductive plates arranged in a stack with a gap separating any pair of said plates, a first resistor voltage divider electrically coupled to said plates, and a capacitor voltage divider electrically coupled to said plates in parallel with the first resistor voltage divider, wherein said capacitor voltage divider is configured such that an electric field generated by said first plurality of conductive plates in response to application of a voltage pulse to said stack in substantially homogeneous at least along a longitudinal of said stack; one or more balancing capacitors for correcting effects that cause nonlinearity; and a detector disposed downstream of said accelerator and configured to detect at least one property of said accelerated ions.

In some embodiments, the capacitors in the capacitor voltage divider can be discrete capacitors having values that substantially compensate for parasitic capacitances in the first plurality of conductive plates.

In some embodiments, a first plate of the first plurality of conductive plates can be electrically coupled to a source configured to provide said RF pulse.

In some embodiments, the ring stacked accelerator can further comprise a second plurality of conductive plates arranged in a stack with a gap separating any pair of said plates; and a second resistor voltage divider electrically coupled to said second plurality of conductive plates, wherein the second plurality of conductive plates can be configured to be energized with a DC voltage.

In some embodiments, each of said plates can comprise a central opening for passage of said ions therethrough.

In some embodiments, the longitudinal axis extends through centers of said central openings.

In some embodiments, a method can be provided for improving the RF performance of a mass spectrometer having a ring stacked accelerator, comprising steps of estimating plate-to-plate capacitance for plates in said ring stacked accelerator; estimating parasitic capacitances for the plates at one or more RF frequencies; determining capacitance of one or more compensation capacitors for compensating said parasitic capacitances; utilizing said capacitors to form a capacitor voltage divider for electrical coupling to the plates of the stacked accelerator, such that an electric field generated by the plates in response to application of an RF voltage pulse having said one or more frequencies across said stacked accelerator is more homogenous than a respective electric field generated by application of said pulse to the stacked accelerator in absence of the capacitor voltage divider; and correcting effects that cause nonlinearity.

In some embodiments, the step of correcting effects that cause nonlinearity can comprise providing one or more balancing capacitors.

In some embodiments, the method can further comprise testing the mass spectrometer to confirm that the capacitor voltage divider improves performance of the mass spectrometer when said RF voltage pulse is applied to the ring stacked accelerator.

In some embodiments, the step of determining the capacitances of said one or more compensation capacitors can further comprise calculating values for each capacitor in the capacitor voltage divider such that the capacitance at each plate can be substantially the same at said one or more RF frequencies.

In some embodiments, the method can further comprise the step of simulating an electric field generated by the ring stacked accelerator with the capacitor voltage divider prior to the step of electrically coupling the capacitor voltage divider to the plates.

In some embodiments, the RF pulse can be a high voltage pulse of approximately 1 μs duration, and optionally wherein said RF pulse can have a substantially uniform amplitude over the pulse duration.

FIG. 1 is a diagram of the components of an exemplary embodiment of a mass spectrometer 20. Ion source 22 provides ions from a sample under test. Ring stacked accelerators 24 and 26 provide electric fields for accelerating the ions from source 22 along ion path 30. RSA 24 is a pulsed accelerator, which allows for providing a gating function to accelerate ions on demand. RSA 26 includes a DC section that provides a uniform DC electric field that further accelerates ions that have undergone acceleration by RSA section 24. In some embodiments, ion mirrors 34 and 36 provide electric fields that cause ion path 30 to reflect, which allows the mass spectrometer to be placed in a more compact housing. After travelling along ion path 30, ions land at detector 38, where the spectrometer detection can occur. In some portions of the ion path 30, the ions can be subjected to an electric field (e.g., in the region 40, or within the ion mirrors 34 and 36). The last portion of the ion path 30 comprises a field-free region through which the ions pass to reach the detector 38. This detection of the ions by the ion detector 38 may occur in accordance with any technique as understood in the art.

Figure 2:
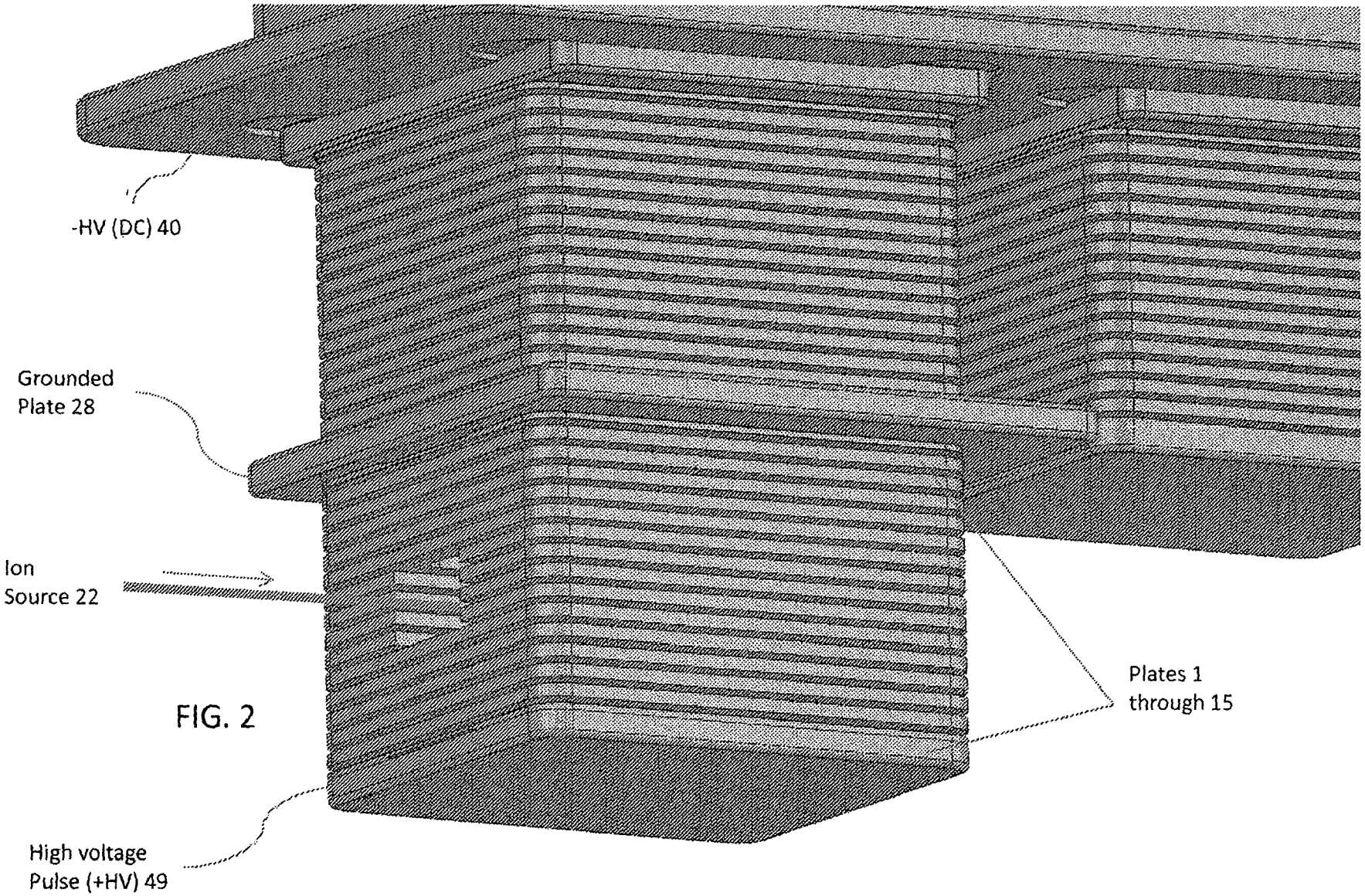
FIG. 2 is a perspective view of an exemplary ring stacked accelerator (RSA) that can be used with some embodiments.

FIG. 2 is an external perspective view of the RSA of the exemplary mass spectrometer of FIG. 1, including both the DC RSA section 26 and the RF-pulsed RSA section 24. The RF-pulsed section 24 of the RSA includes plates 1-15. Each of the plates 1-15 and the other plates shown include an aperture that allows ions to pass therethrough. This aperture allows each plate to act as a ring in a ring stack. Plate 1, furthest from grounded plate 28, can be charged via application of a high voltage pulse 49. A voltage divider in parallel with plates one through 15 can apply successively smaller voltages to each of plates 1 to through 15. Ideally, the voltage divider allows applying voltages to the plates, which linearly vary from plate 1 to plate 15, such that the voltage difference between plates 1 and 2 is substantially the same as the voltage difference between plates 5 and 6, 9 and 10, 14 and 15, etc. It should be appreciated that the polarity of high voltage pulse 49 can be chosen based on the type of ion being accelerated. The voltages applied to the plates 1 through 15 will generate axial electric fields that will accelerate the ions. The accelerated ions move past the grounded plate 28 and are further accelerated by the DC RSA section 26 towards the ion mirror 34.

Figure 3:
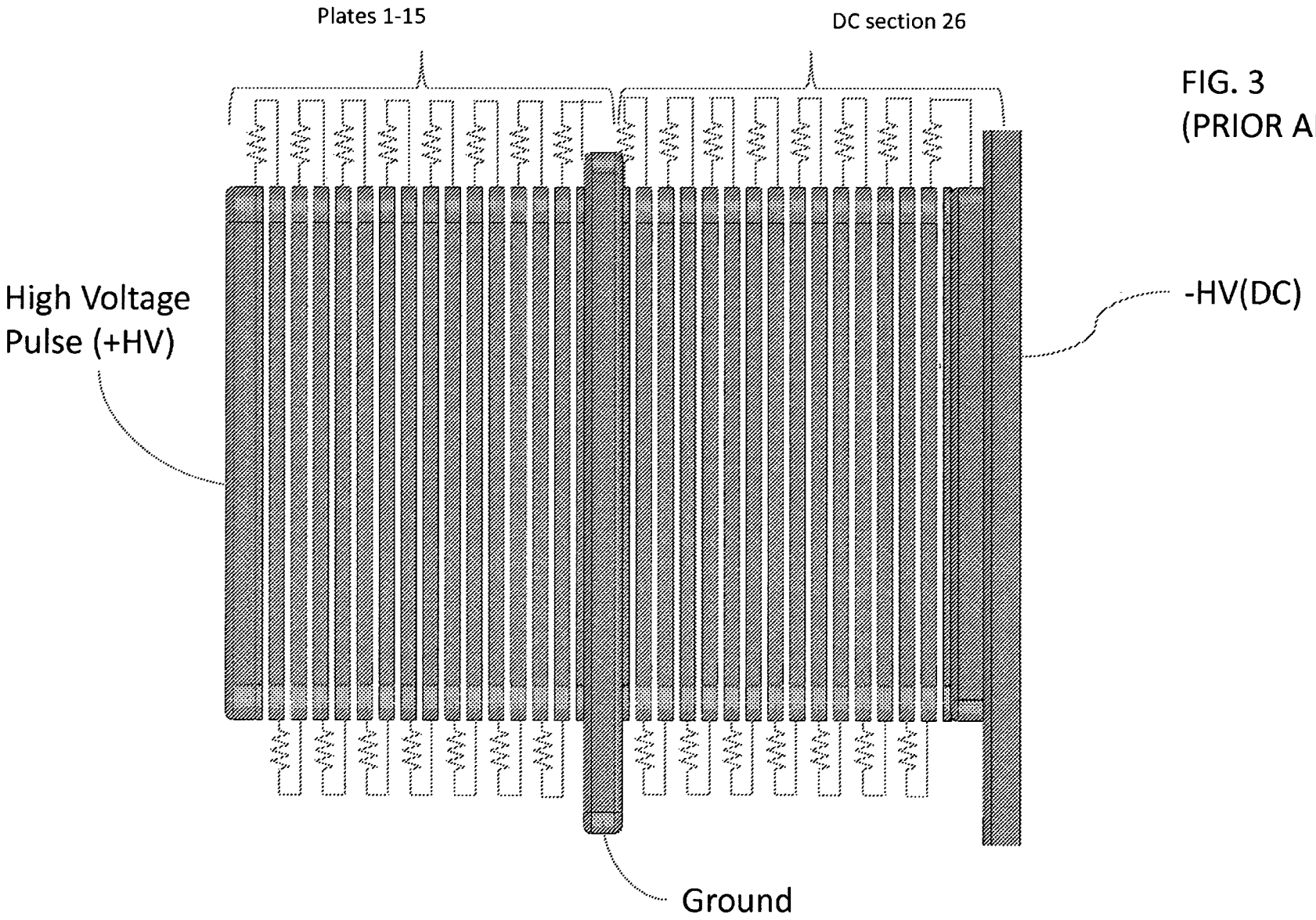
FIG. 3 (PRIOR ART)
FIG. 3 is a side view of an exemplary prior art RSA, including circuit elements.

FIG. 3 shows an exemplary arrangement of voltage dividers placed in parallel with the plates in the accelerator pulsed section 24 and DC section 26. Plates 1 through 15, in pulsed section 24, include a plurality of resistors placed between each pair of plates. Because the plates are conductive, each plate interacts with other plates with an inherent capacitance, the resistors act as a resistor voltage divider in parallel with the natural capacitance voltage divider created by the plates. Each plate in plates 1 through 15 experiences a steady-state voltage that is linearly divided between plates 1 and 15 if each of the resistors is the same. The same voltage divider can be applied in DC section 26. This arrangement can be seen in the prior art. Without compensation, however, the plates 1-15 in the pulsed section can experience non-linear transient voltages when RF pulses are applied across the stack. This transient behavior occurs because the actual effective capacitance varies between plates due to parasitic capacitances, e.g., between multiple plates and the walls of the spectrometer.

Figure 4:
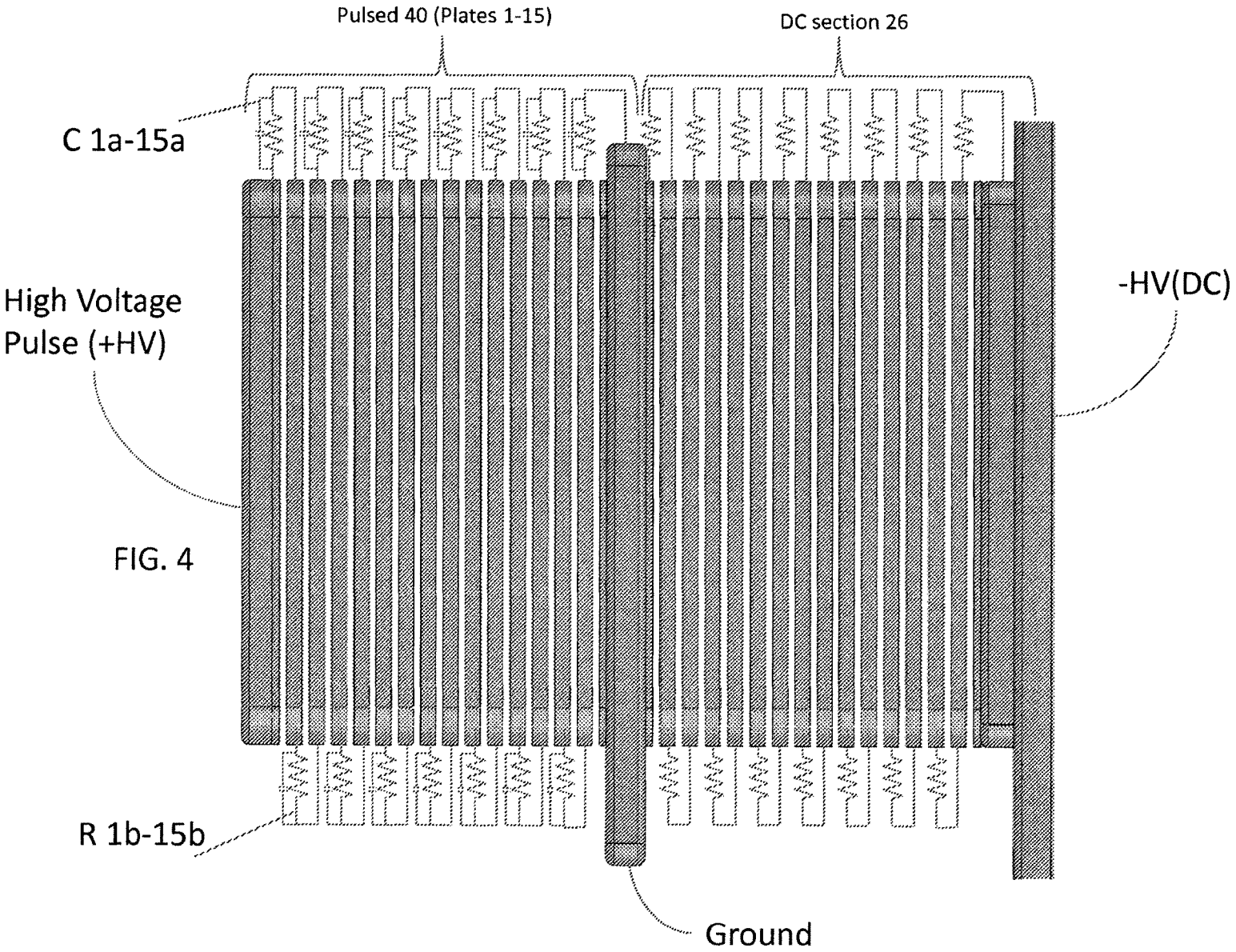
FIG. 4 is a side view of an exemplary RSA that can be used with some embodiments, including circuit elements.

FIG. 4 shows an exemplary embodiment of an RSA according to the present teachings that utilizes compensating capacitors **1*a*-15*a* to compensate for the parasitic capacitances at plates one through 15 when using RF pulses to energize the pulsed section of the RSA. In this example, pulsed section 40 includes compensating capacitors 1*a*-15*a* in parallel with the resistors 1*b*-15*b*. By placing capacitors in parallel with the resistors, a compensating capacitance voltage divider can be created to compensate for the differences in capacitances experienced at each plate. In the absence of the compensating capacitors, at higher frequencies, such as during the application of an RF pulse, the variance in capacitance between different plates can create inhomogeneous impedances in the voltage divider between plates 1 and 15. These inhomogeneous impedances can result in nonlinear voltages between plates 1-15, which can in turn result in an inhomogeneous electric field. The capacitances used in the capacitor voltage divider can be chosen through various techniques, such as simulation or measurement or both, including the technique shown in FIG. 11**, to ameliorate, and preferably eliminate, such inhomogeneities in the generated electric fields.

Figure 5:
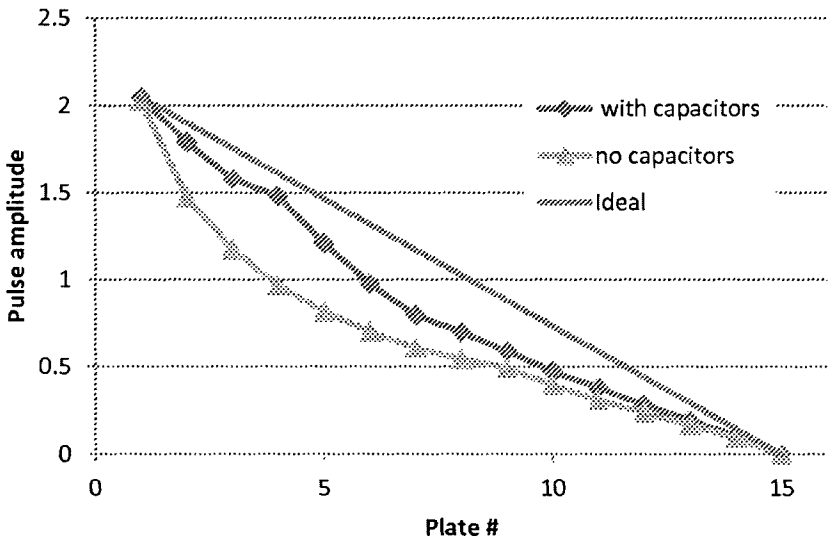
FIG. 5 is a graph depicting voltages measured at plates in exemplary RSAs.

FIG. 5 shows the voltages at each of plates 1-15 during an RF pulse observed in exemplary implementations of examples in FIGS. 3 and 4 versus the ideal voltages for each of these plates, which assumes a perfect voltage division. The resistance of the resistors **1*b*-15*b* employed in these examples were, respectively, 1 megaOhm each, and the capacitance of the capacitors 1*a*-15*a*** employed in these examples were, respectively, 88 pF, 68 pF, 37 pF, 27 pF, 20 pF, 10 pF, 1 pF, 1 pF, 1 pF, 1 pF, 1 pF, 1 pF, 1 pF, and 1 pF.

The RF pulse had a frequency of 10,000 Hz and a pulse amplitude of 2000V at the plate 1. The top, line represents the ideal linear voltage division, which is similar to the ideal DC voltage division where each resistor in the voltage divider is equivalent. The second line, which deviates slightly from this ideal, is the observed voltages at each of the plates during the RF pulse when compensation capacitors, as shown in FIG. 4, are used to help normalize the impedance at each plate. The lower curve, which deviates more substantially from the ideal, is the observed voltages at each plate during the RF pulse when no capacitors were used to compensate for impedance, such as shown in FIG. 3. As can be seen, the RF-pulsed RSA section that utilizes compensation capacitors more closely approximates the ideal voltage division, which will result in a more uniform electric field during operation when the RSA is energized using the RF pulse.

Figure 6:
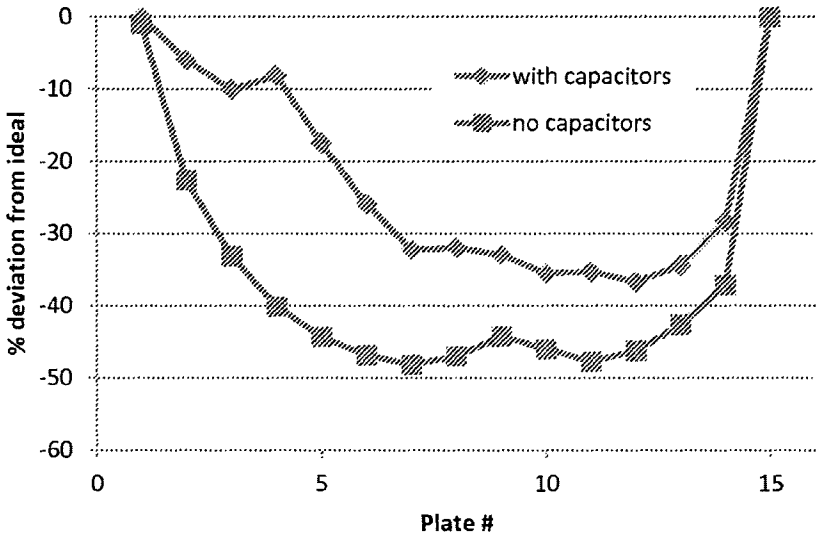
FIG. 6 is a graph depicting voltage errors from ideal measured at plates in exemplary RSAs.
Figure 7:
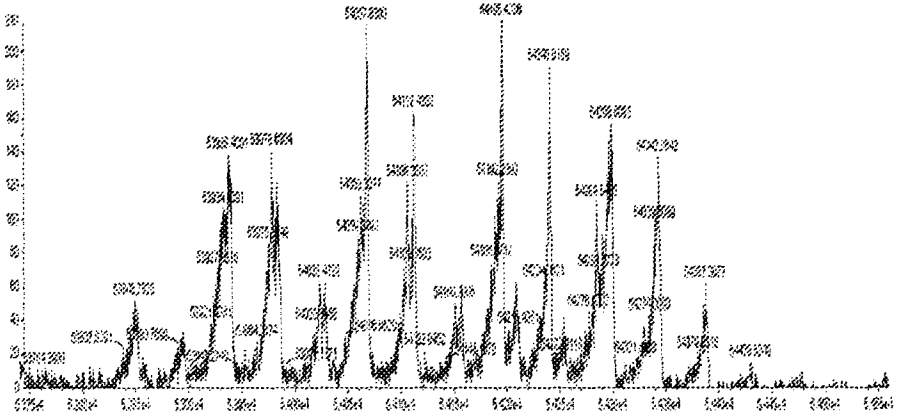
FIG. 7 is a graph depicting exemplary test results when an RSA is uncorrected when energized with a pulse.

FIG. 6 shows the deviations of the RF voltages observed at each of the plates 1-15 of the RSA section 24 in the examples discussed above in connection with FIG. 5 relative to ideal voltages when compensation capacitors are used versus when only a resistance voltage divider is used. More specifically, the top curve shows the percentage error between the observed voltage and the ideal voltage when compensation capacitors are used, and the lower curve shows the percentage error when only a resistance voltage divider is used. As can be seen, when compensation capacitors were used, a large number of plates experience less than 30% error. Meanwhile, almost all plates experienced greater than 30% error when only a resistance voltage divider was used. The lower error associated with the use of compensation capacitors indicates a more homogeneous electric field generated by the plates 1-15 of the RSA section 24 for accelerating the ions. The more uniform electric field can in turn result in greater fidelity during ion detection. FIG. 7 shows the exemplary signal observed at the detection circuit of a TOF mass spectrometer in an example when only a resistance voltage divider is used (such as in FIG. 3). As can be seen, the peaks are generally broad, indicating a low resolution. For example, the inhomogeneous electric field applied to the ions during the initial acceleration of the ions into the spectrometer can broaden the energy spread associated with ions having the same m/z ratio, thereby leading to increase variation in the flight time for ions of the same mass-to-charge resulting in low resolving power and broad assymetric peaks.

Figure 8:
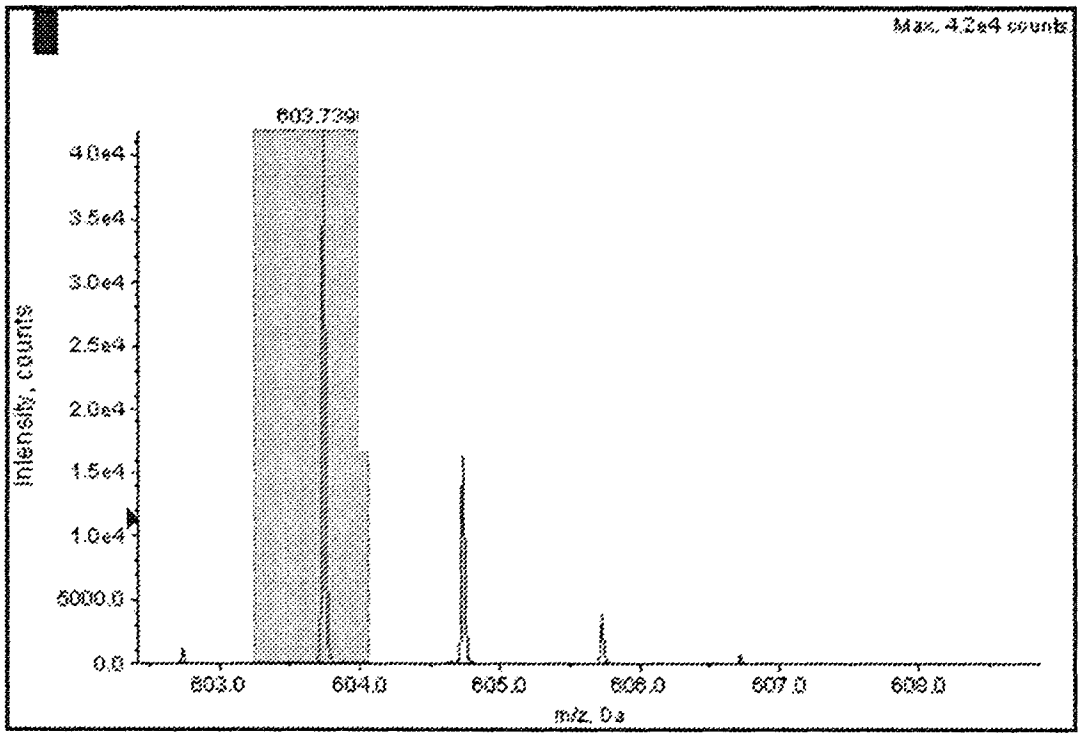
FIG. 8 is a graph depicting exemplary test results when an RSA is corrected in accordance with some embodiments, when energized with a pulse.

In contrast, FIG. 8 shows the observed mass signals in a range of 603.25 to 604.07 Da when compensation capacitors 1*a*-15*a*, as shown in FIG. 4, having capacitances of 88 pF, 68 pF, 37 pF, 27 pF, 20 pF, 10 pF, 1 pF, 1 pF, 1 pF, 1 pF, 1 pF, 1 pF, 1 pF, and 1 pF, respectively, were used in the RF pulsed section of the RSA. Here, ions of the same mass-to-charge but with different starting locations in the accelerator had low variation in the time to travel between the point of the acceleration to detection. The resolving power was much higher, the peaks narrower, and the signal-to-noise was increased. This was due to the more homogeneous electric field created within the RSA during an RF pulse event. This can result in higher quality detection within the spectrometer.

Figure 9:
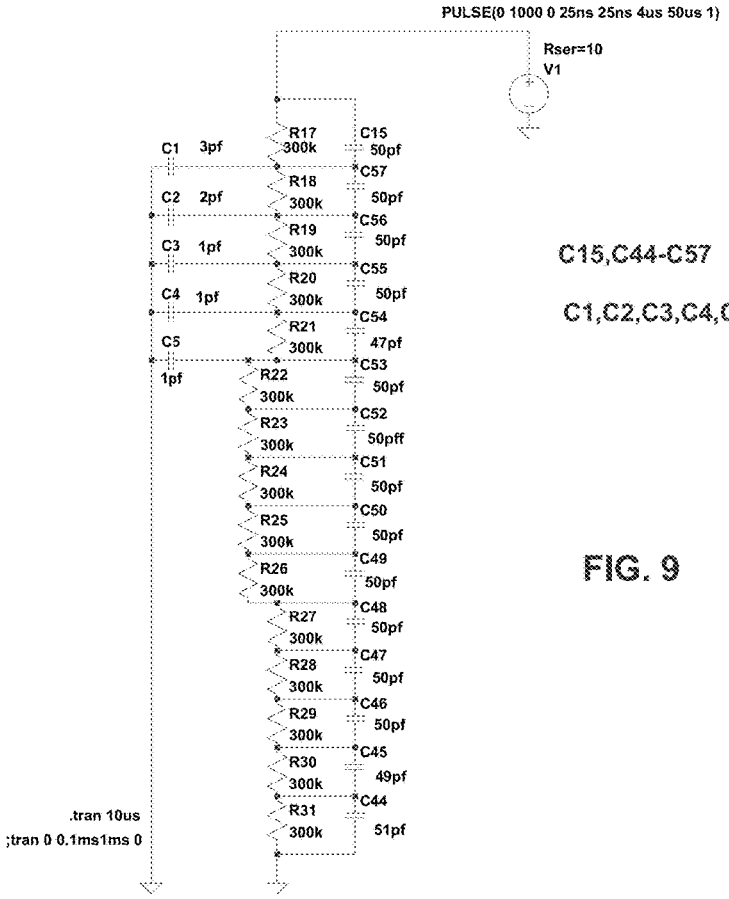
FIG. 9 is a circuit diagram of an RSA that does not correct for parasitic capacitance.

FIG. 9 shows an exemplary equivalent circuit expected in the pulsed section of an RSA, under a model in which each plate is assumed to have a capacitance relative to an adjacent plate of approximately 50 pF. In this example, the circuit of a 16 ring-ring stack accelerator is shown. Each resistor of the voltage divider has a resistance of approximately 300 kΩ. In this example, parasitic shielding capacitors are used in conjunction with the first five plates. The assumption with regard to the capacitance between the adjacent plates may not, however, be correct at high frequencies, resulting in non-uniform impedance, and therefore non-uniform electric field. Capacitors, C44 through C57 and C15 are the plate-to-plate capacitances. Resistors R17 through R31 are the applied resistors between the rings. Capacitors C1 through C5 are the estimates of the parasitic capacitances. The high voltage pulse is applied at the junction where resistor R17 and capacitor C15 are joined. The RSA is grounded at the junction where resistor R31 and Capacitor C44 are joined.

Figure 10:
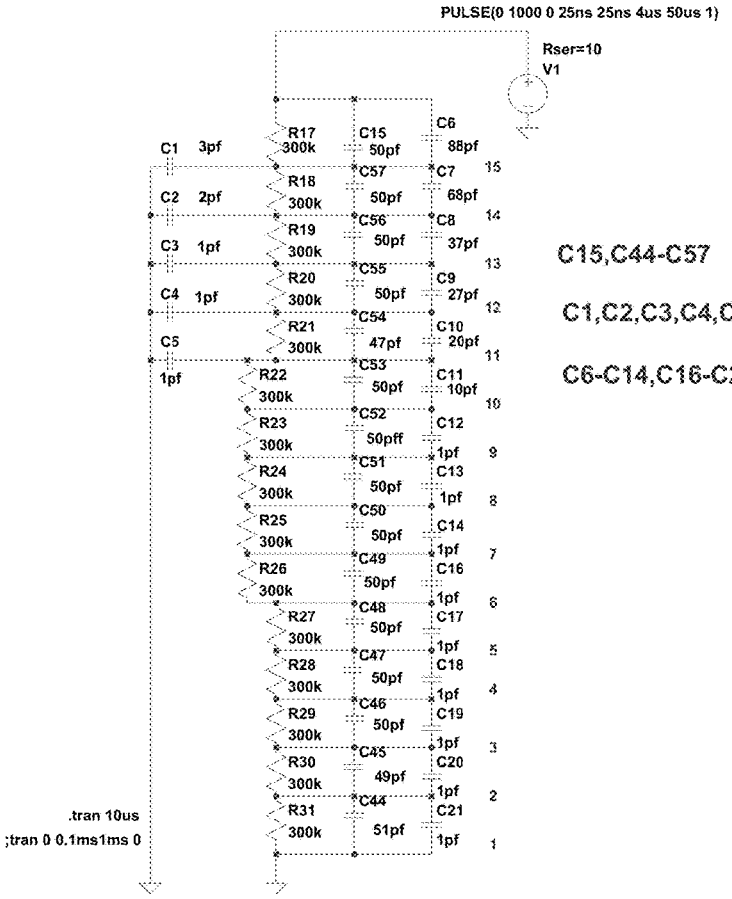
FIG. 10 is a circuit diagram of an RSA that does correct for parasitic capacitance, in accordance with some embodiments.

As an example, the circuit of a 16 ring RSA shown in FIG. 10 can address this issue. Here, in addition to the ideal model for capacitance between the adjacent plates, an additional capacitance voltage divider, shown on the right side, is added. This results in the structure shown in FIG. 4 and the related results in FIGS. 5, 6, and 8, by way of example. Individual values of these capacitors can be chosen using any suitable means, such as simulation, empirical observation, or any combination thereof, including the method shown in FIG. 11, and discussed below. By adding these capacitors, the parasitic capacitances experienced at each plate can be compensated for. Capacitors C44 through. C57 and C15 are the plate-to-plate capacitances. Resistors R17 through R31 are the applied resistors between the rings. Capacitors C1 through C5 are the estimates of the parasitic capacitances. Capacitors C6 through C21 are the applied compensation capacitors. The high voltage pulse is applied at the junction where resistor R17 and capacitors C6 and C15 are joined. The RSA is grounded at the junction where resistor R31 and Capacitors C44 and C21 are joined.

FIG. 11 shows an exemplary method 100 for choosing compensation capacitors according to the present teachings for use in an RSA voltage divider, such as shown in FIG. 4. At step 101, the plate-to-plate capacitance between each plate in the ring stack can be estimated in a static model for application of DC voltages to the plates. By way of example, this can be done through simulation, calculation, or by measuring the relative capacitance between each pair of plates using a low capacitance probe. At step 102, the performance of the accelerator without compensation capacitors can be tested by application of a high voltage pulse of a predetermined duration, such as 1 μs, to the accelerator for obtaining a mass spectrum of a sample, e.g., a known calibration sample. This step may be optional, and may be helpful in avoiding unnecessary compensation, should the resulting spectrum have enough resolution for the task at hand. It is, however, expected that in many cases the results of this test will appear similar to the spectrum shown in FIG. 7, e.g., indicating broadening of the mass peaks due to inhomenegeities in the pulsed field generated by the RSA.

At step 103, the parasitic capacitance associated with the plates can be estimated using simulation tools. An example of suitable simulation tool includes, e.g., PSPICE marketed by Cadence Design Systems, Inc. of San Jose, Calif. The parasitic capacitance can include, e.g., plate-to-plate capacitance, the parasitic capacitance between groups of plates and a single plate, as well as plate-to-wall capacitance. The simulation can take into account the overall environment for a given plate. At step 104, the estimates of parasitic capacitance associated with each plate can be used to adjust the plate-to-plate capacitance estimates that were obtained in step 101.

Once the parasitic capacitances are accounted for in the model of the ring stack, at step 105, an electrical effective circuit model of the RSA that includes the estimated parasitic capacitance can be generated. This circuit model can be utilized to simulate the performance of the RSA. The simulation can be performed using conventional computer-aided simulation tools. It should be appreciated that the simulation steps in method 100 are generally performed using a processor and related computer hardware, such as a workstation, PC, laptop, handheld device having suitable processing power, etc. In some embodiments, the processor may be a web-based processor.

At step 106, the circuit model can be employed to select compensation capacitors so as to account for the effects of the parasitic capacitances. For example, for an initial set of capacitance values for the compensation capacitors, the effective capacitance between each pair of the capacitors at a given RF frequency can be simulated. The capacitance values can be adjusted and the simulation repeated until the effective capacitance between each pair of the plates is approximately the same, e.g., the variation of the effective capacitance between different pairs of plates can be less than about 5%. In some embodiments, this step can be manual or automatic, such as through software that recommends compensation capacitors. The software can also allow the performance of a large number of iteration steps to arrive at the optimal values for the capacitance of the compensation capacitors.

At step 107, the optimal values of the capacitance of the compensation capacitors can be employed to generate a circuit schematic, e.g., by utilizing a conventional software package, that includes a capacitance voltage divider, which incorporates the compensation capacitors, in parallel with the resistance voltage divider. In some embodiments, once the final circuit schematic is generated, a printed circuit board (PCB) can be produced that includes the resistance voltage divider and the chosen capacitors. This PCB can be incorporated in an accelerator of an RSA for accelerating ions in a mass spectrometer.

In some embodiments, at an optional step 108, the accelerator incorporating the compensation capacitors can be tested, in laboratory or under field conditions, e.g., by using a high voltage RF pulse having a predetermined duration, such as 1 μs. During this step, a low capacitance probe can be employed to observe the actual capacitances at each plate in the ring stack. This can be used to adjust the model of the circuit. In some embodiments, the capacitance at each plate can be observed prior to adding the compensation capacitors, while the instrument is not energized. In some embodiments, the RSA can be operated independently from the rest of the spectrometer to make it easier to access the plates.

At an optional step 109, in some embodiments, the result of test 108 may be used to update the model for parasitic capacitance or choose other capacitances, e.g., in a repeat of the steps 101-107. The schematic for the resistance and capacitor voltage divider that will drive the ring stack can be finalized. Simulation can further be performed to verify that the circuit is optimized. Once a circuit is finalized, a PCB having that circuit can be generated and applied to the instrument to drive the plates in the ring stack. At step 110, the full instrument can be tested utilizing the compensated circuit using a test sample to generate a test spectrum. This spectrum may have characteristics substantially similar to the spectrum shown in FIG. 8 if the compensation capacitors have been properly chosen.

Figure 12:
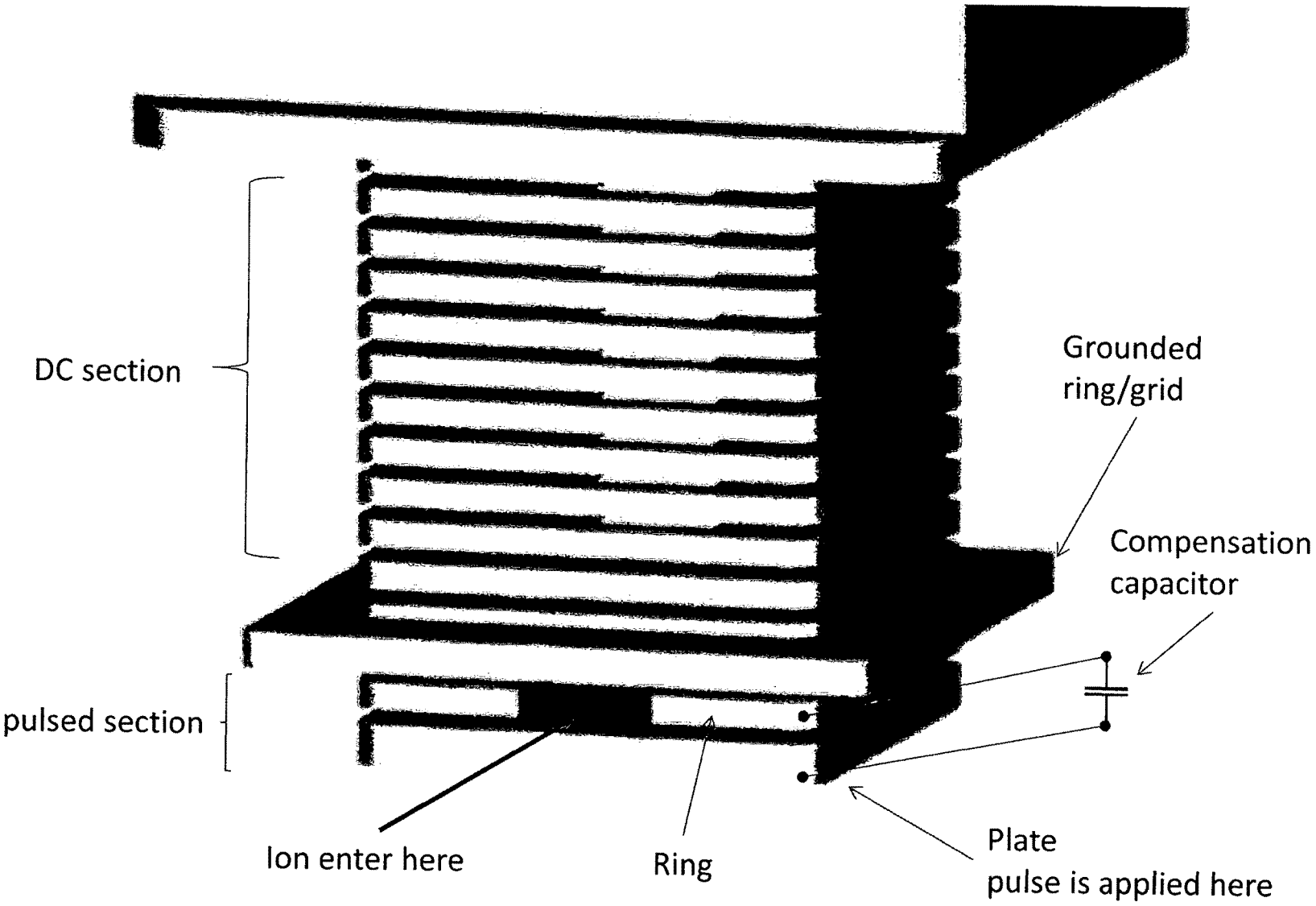
FIG. 12 illustrates a 3D isometric view of a three plate RSA in accordance with some embodiments.
Figure 13:
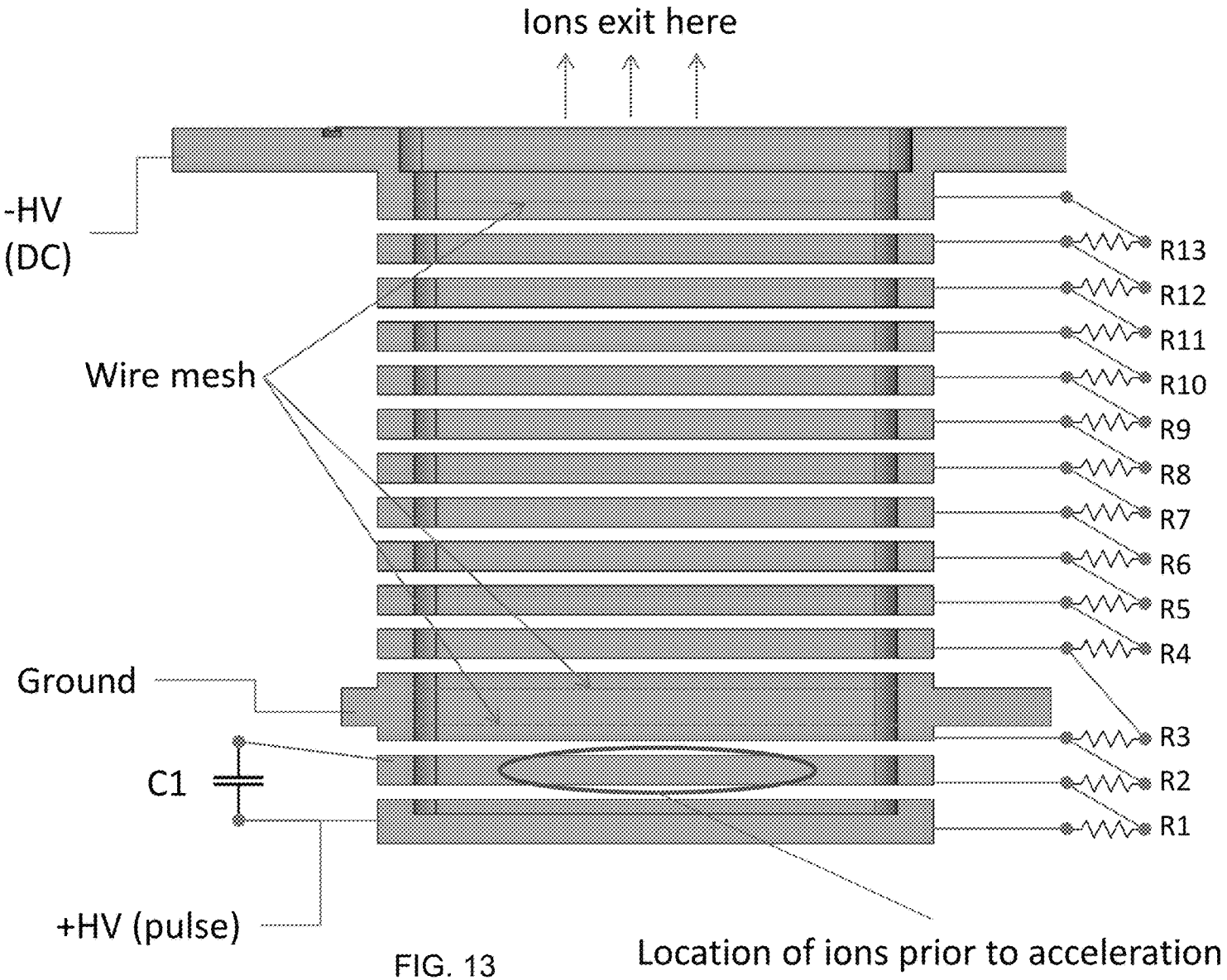
FIG. 13 is a cross-section of the three plate RSA depicted in FIG. 12 in accordance with some embodiments.
Figure 14:
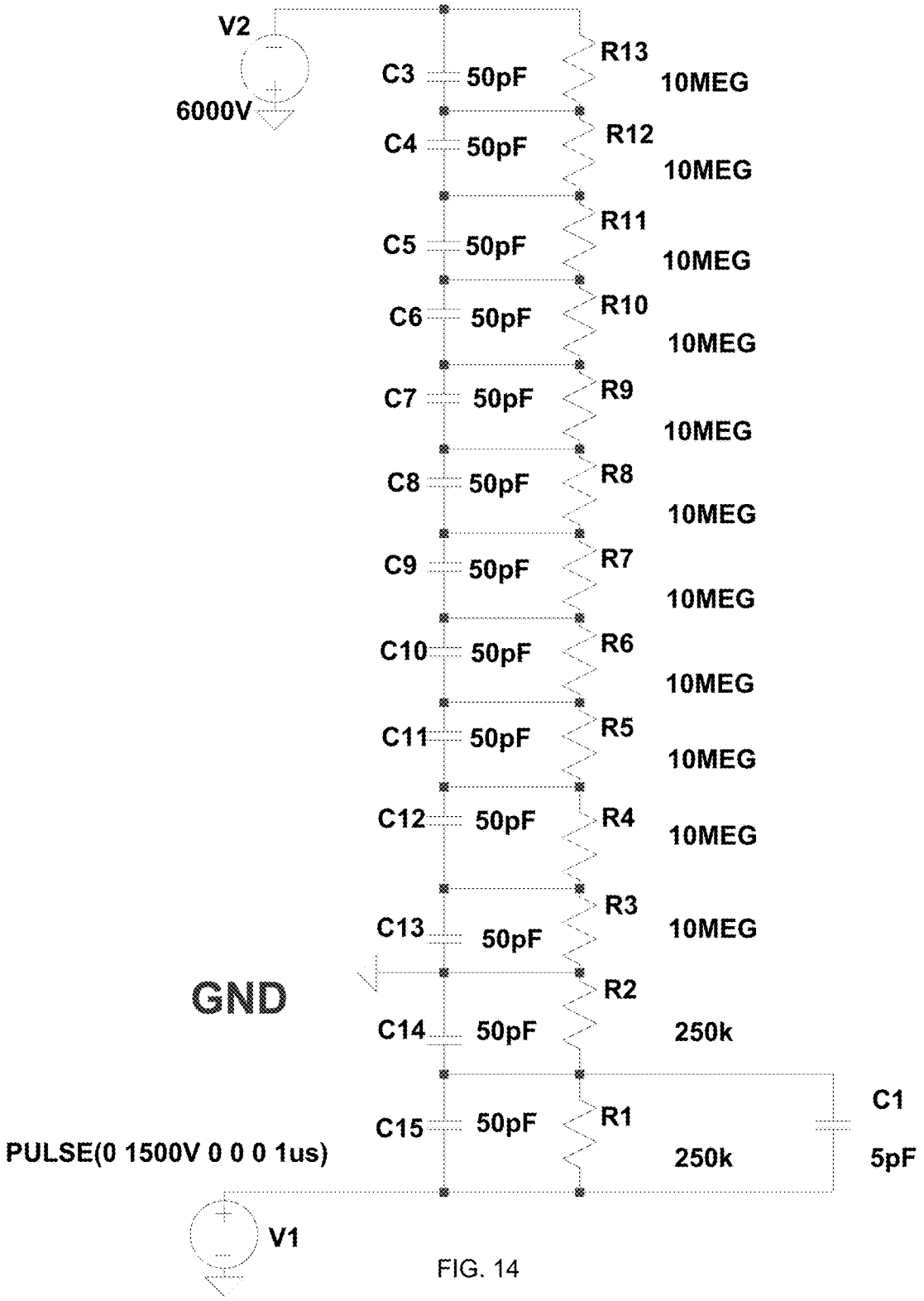
FIG. 14 is a circuit diagram of a three plate RSA that does correct for parasitic capacitance in accordance with some embodiments.

In various embodiments, a three plate arrangement can be provided wherein a single balancing capacitor, also referred to as a compensation capacitor, can be used as shown in FIG. 12. FIG. 12 shows a 3D isometric view of a possible embodiment of a 3-plate accelerator stack. Note that the pulsed section is followed by DC section. The location and attachments of the compensation capacitor is shown. Plate-to-plate and parasitic capacitances are not indicated. Resistors are also not indicated for simplification. FIG. 13 shows a cross-section of the 3 ring RSA depicted in FIG. 12. The single compensation capacitor or balancing capacitor is labeled C1. The value of C1 is chosen to correct the effects of the parasitic capacitances. A typical value for C1 is 5 picoFarads. The plate-to-plate capacitances and the parasitic capacitances are not indicated. The resistors R1 through R13 are indicated. The AC section has different value resistors (R1 and R2) than the DC section of the accelerator (R3 through R13). The values of R1 and R2 must be equal. The values of R3 through R13 must be equal to each other, but not necessarily equal to R1 and R2. In various embodiments, FIG. 14 shows the circuit for a 3 ring RSA. Capacitors C3 through C15 are the plate-to-plate capacitances, for a particular size and spacing (70 mm×76 mm and 4 mm spacing). The compensation capacitor or balancing capacitor is labeled C1. Resistors are also used, and are labeled R1 through R13. Resistors R1 through R13 are the applied resistors, typical values are indicated. The high voltage pulse is applied at the junction where capacitors C1 and C15 and resistor R1 are joined. The high voltage DC is applied at the junction where Capacitors C3 and resistor R13 are joined. The assembly is grounded at the junction where capacitors C13 and C14 and resistors R2 and R3 are joined. The pulsed section of the accelerator has lower value resistors than the static voltage section of the accelerator. The primary function of the resistors in the pulsed section is to assure that the voltage of all the pulsed plates are zero soon after the pulse returns to ground. Note, the dividing of the voltage in the pulsed section is capacitive, not resistive. In the static voltage section, or DC section, the voltage dividing is entirely ohmic. The plates create capacitors. In various embodiments, the value of this capacitance is about 50 picoFarads (pF). In this figure, (FIG. 14), the estimates of the parasitic capacitances are not indicated.

Figure 15:
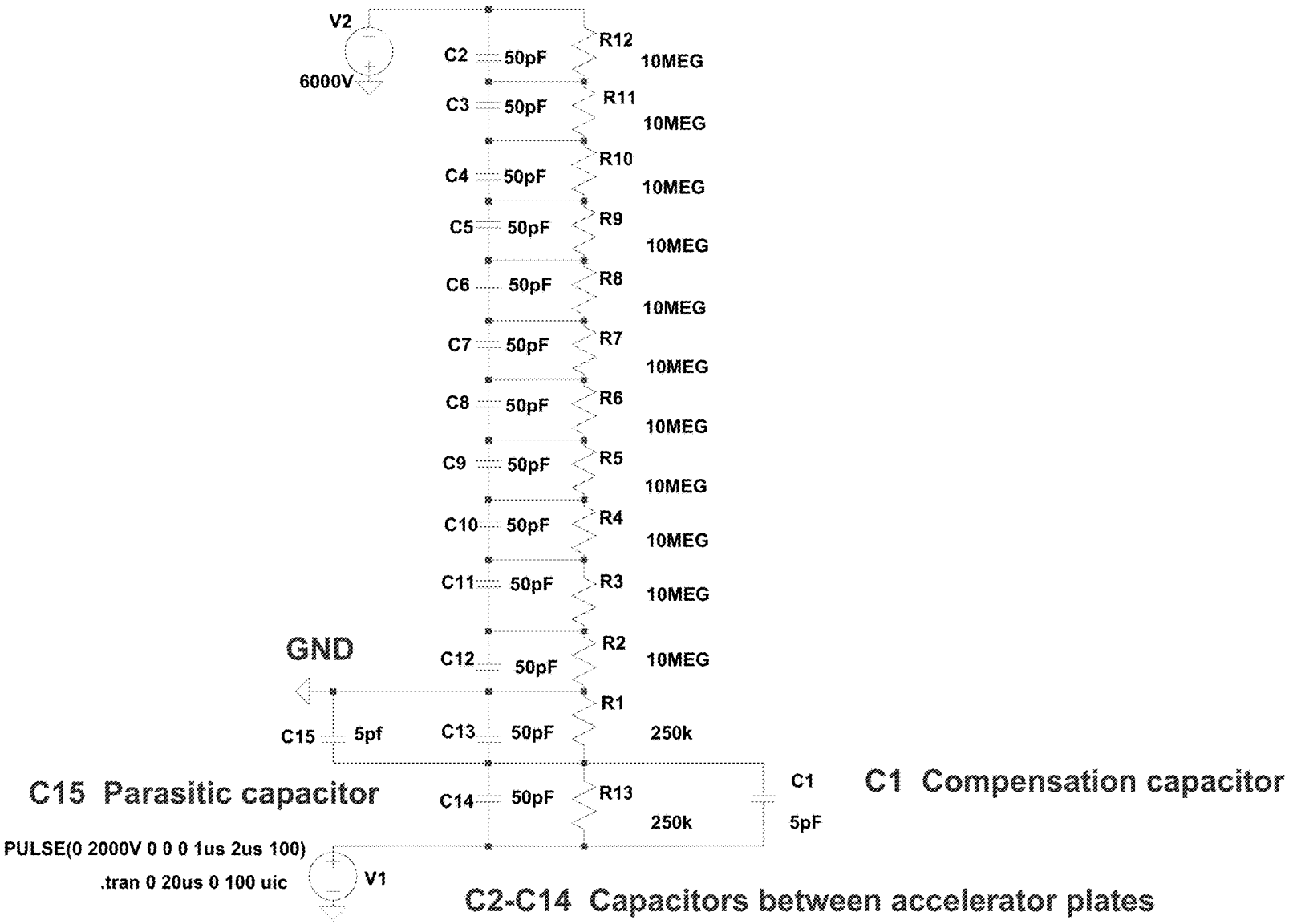
FIG. 15 is a circuit diagram of a three plate RSA in accordance with some embodiments.

FIG. 15 shows the circuit diagram of the 3 ring stack accelerator including the parasitic capacitance. Also shown is the DC section of the accelerator as well. In this case, the parasitic capacitance issue affects only one ring: the ring located between the pulsed plate and the grounded ring/grid. Only one compensation or balancing capacitor is required for a three ring-ring stack accelerator.

Figure 16:
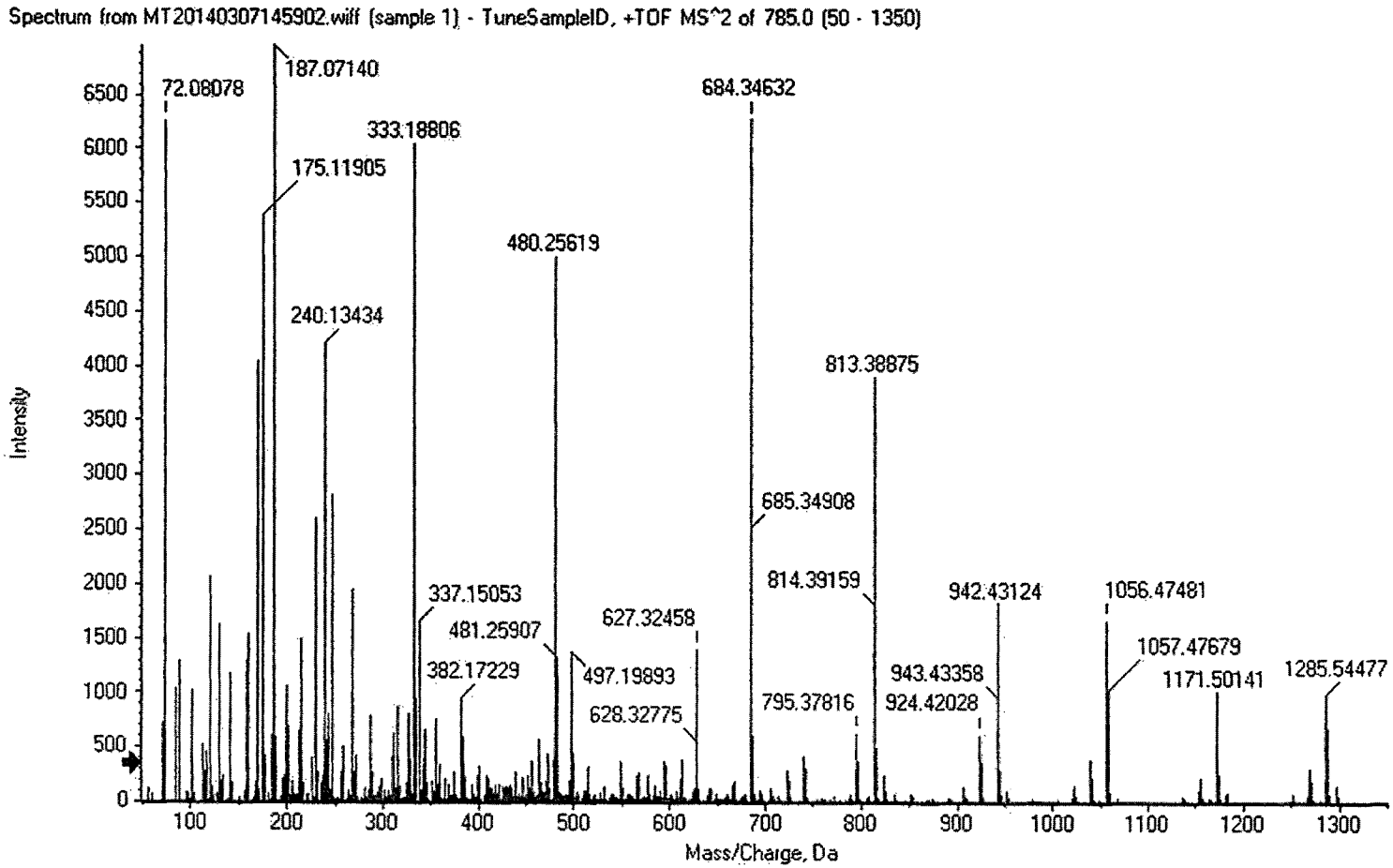
FIG. 16 shows a typical mass spectrum in accordance with some embodiments.

FIG. 16 shows a typical mass spectrum that can be obtained when the compensation or balancing capacitors are applied. This is a collisionally induced fragmentation spectrum of glu fibrino peptide, with collision energy of 40 electron-volts. Nitrogen was used as the collision gas. The resolution was quite good, over 20,000 for all masses.

FIG. 17 shows a table of masses observed in the spectrum shown in FIG. 16. Note that across a very wide mass-to-charge range (72 amu to 1285 amu), the observed masses are quite close to the theoretical masses. In this case, and linear mass calibration equation was used.

Figure 18:
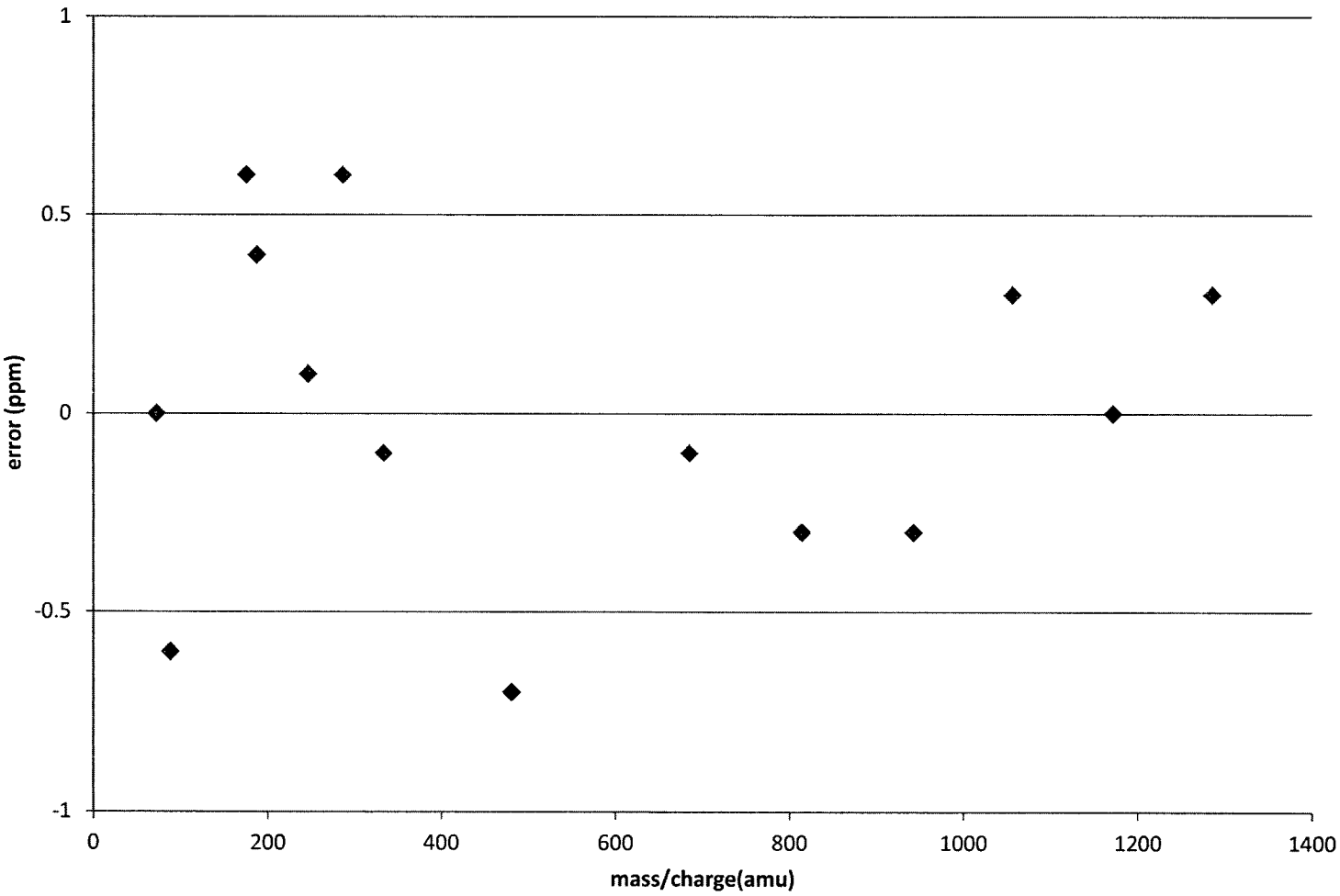
FIG. 18 shows the masses listed in FIG. 17 in a graph.

FIG. 18 shows the masses listed in FIG. 17 in a graph.

Figure 19:
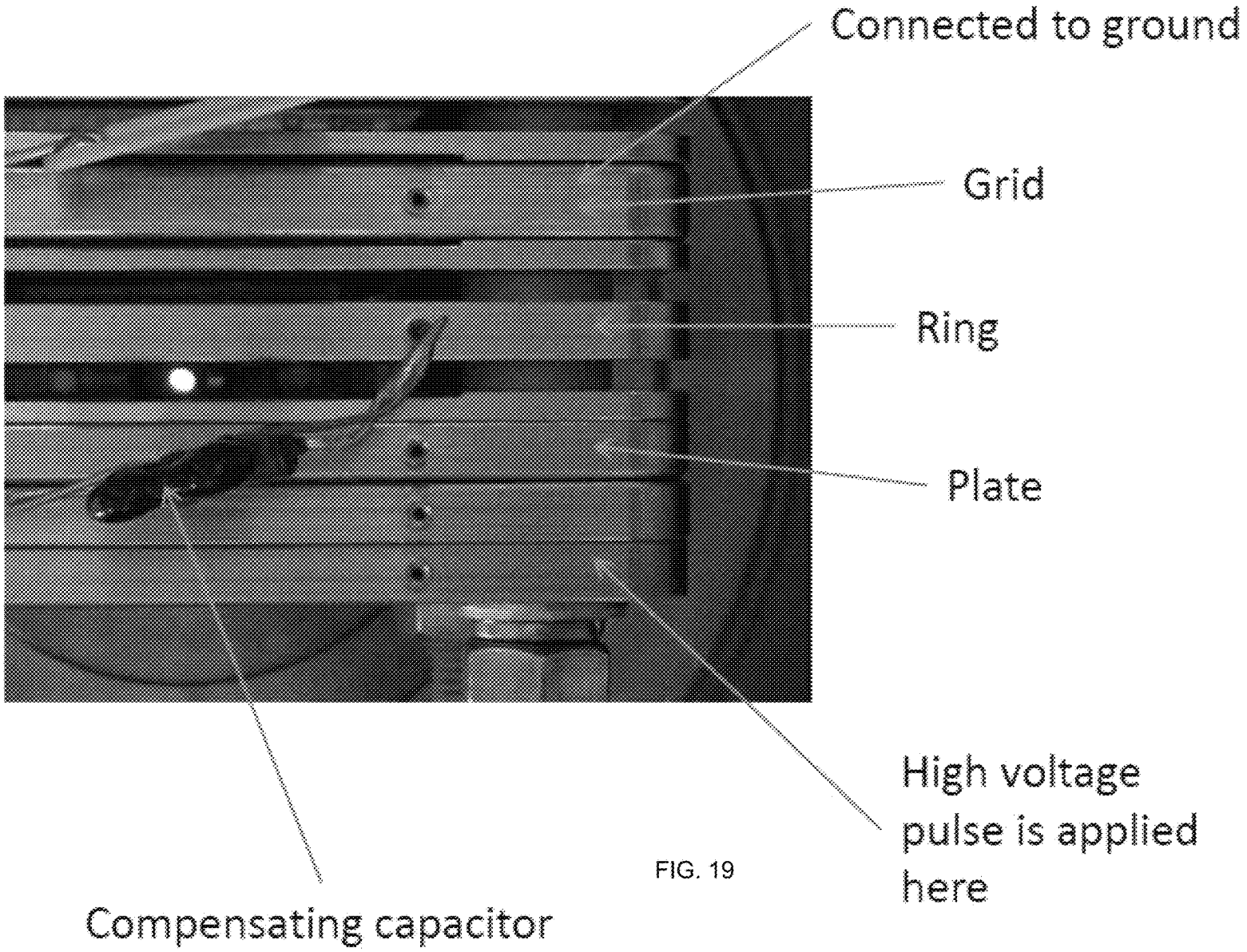
FIG. 19 shows a photo of a stack of three plates in accordance with some embodiments.

FIG. 19. Shows a photo of one embodiment of this invention. Shown is a stack of three rings. The rings are labeled "Plate", "Ring", and "Grid". The ring labeled "Plate" is connected to the high voltage pulse. The ring labeled "Grid" is connected to ground. The ring labeled "Ring" is connected to both the "Plate" and the "Grid" by 250 kΩ resistors. "Ring" is also connected to "Plate" by a compensating capacitor, 5 picoFarads (pF) in this case. The gap between "Plate" and "Ring" is precisely equal to the gap between "Ring" and "Grid" and the plates are precisely parallel. In the case of a three ring stack, the only electrode that is affected by parasitic capacitance is the middle one: "Ring". To determine how to apply the compensating capacitor to this stack, the capacitance between "Plate" and "Ring" was measured. The capacitance between "Ring" and "Grid" was also measured. The values were compared and it was determined that there was a 5 pF difference. Thus, a 5 pF compensation capacitor was chosen and applied to balance the capacitance. It was important to do the measurements in an environment as similar as possible to the final installation, as the parasitic capacitances are highly variable depending on the surrounding environment. In the case of the 3 ring stack, making the choice of compensation capacitor is significantly easier than other multi-ring stacks that have more rings. If more than three rings are used, simulations may be required in order to estimate the effect of the parasitics.

Those having ordinary skill in the art will appreciate that various changes can be made to the above embodiments without departing from the scope of the invention.

What is claimed is:

1. A mass spectrometer system comprising:

an accelerator comprising a first plurality of conductive plates arranged in a stack with a gap separating any pair of said plates;

a voltage source to provide an RF voltage pulse across the stack;

a first resistor voltage divider electrically coupled to said plates; and one or more capacitors coupled to said plates and configured to allow generating at each plate, in response to application of a voltage pulse across the stack, the RF voltage pulse having an amplitude that varies substantially linearly from a first plate in said stack to a last plate in said stack wherein the amplitude decreases across the stack;

an additional one or more balancing capacitors connected between the plates in the stack for correcting effects that cause nonlinearity;

wherein an electric field created by the first plurality of conductive plates is substantially homogeneous at least along a longitudinal axis of said stack when energized with the RF pulse, the RF pulse having a finite duration and the amplitude of the RF pulse being time varying accelerates and focuses ions through the stack; and wherein ions are allowed to enter when the electric field value is zero and ion trajectory is not perturbed when the stack is not energized with the RF pulse.

2. The system of claim 1, wherein said additional one or more balancing capacitors are arranged to provide a capacitor voltage divider in parallel with said first resistor voltage divider.

3. The system of claim 2, wherein the additional one or more balancing capacitors in the capacitor voltage divider are discrete capacitors having values that substantially compensate for parasitic capacitances in the first plurality of conductive plates.

4. The system of claim 1, wherein said additional one or more balancing capacitors are configured such that the plates exhibit substantially equal electrical impedances at a frequency of an RF pulse.

5. The system of claim 1, wherein each of said plates comprises an opening to allow passage of a plurality of ions therethrough.

6. The system of claim 1, wherein a first plate of the first plurality of conductive plates is electrically coupled to a source configured to provide an RF pulse.

7. The system of claim 1, further comprising:

a second plurality of conductive plates arranged in a stack with a gap separating any pair of said plates; and a second resistor voltage divider electrically coupled to said second plurality of conductive plates, wherein the second plurality of conductive plates is energized via application of a DC voltage thereto.

* * * * *